United States Patent [19]

Gehring et al.

[11] 4,055,157

[45] Oct. 25, 1977

[54] IGNITION DISTRIBUTOR-BREAKER SYSTEM HAVING CENTRIFUGAL TIMING ADJUSTMENT

[75] Inventors: Thilo Gehring, Markgröningen; Heinz Berger, Stuttgart, both of Germany

[73] Assignee: Robert Bosch G.m.b.H., Stuttgart, Germany

[21] Appl. No.: 689,749

[22] Filed: May 25, 1976

[30] Foreign Application Priority Data

Aug. 21, 1975 Germany ..... 2537138

[51] Int. Cl.[2] ..... F02P 5/04

[52] U.S. Cl. ..... 123/117 R; 64/25

[58] Field of Search ..... 123/117 R, 139 AP; 64/25

[56] References Cited

U.S. PATENT DOCUMENTS

| | | | |
|---|---|---|---|
| 1,721,727 | 7/1929 | Bohlman | 123/117 R |
| 2,677,946 | 5/1954 | Purdy | 64/25 |
| 3,320,770 | 5/1967 | Bevacqua | 123/117 R |

*Primary Examiner*—Ronald B. Cox

*Attorney, Agent, or Firm*—Flynn & Frishauf

[57] ABSTRACT

To decrease spark advance upon high-speed operation of a separately ignited internal combustion engine, a spark advance centrifugal timing element, engaging a timing cam, is constructed to be formed of two link elements connected together by a knee joint having a limit position defined by a stop and biased to be normally in that limit position but, upon excessive deflection upon high-speed operation of the engine, permitting breaking of the knee joint counter the bias force so that one of the elements, namely the one engaging the spark advance cam, can deflect with respect to the other and effect some spark retardation with respect to the previously commanded spark advance.

6 Claims, 2 Drawing Figures

IGNITION DISTRIBUTOR-BREAKER SYSTEM HAVING CENTRIFUGAL TIMING ADJUSTMENT

Figure 1:
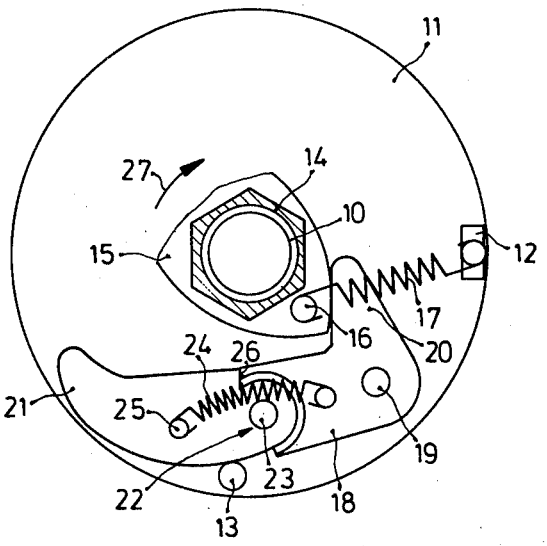

The present invention relates to an ignition distributor-breaker assembly with separately ignited internal combustion engines, and more particularly to the spark advance adjustment thereof controlled by centrifugal force upon rotation of the engine.

Centrifugally operating timing arrangements to time the spark advance of internal combustion engines have previously been proposed; as the engine rotates faster, centrifugal weights are driven outwardly from a predetermined position in order to change the spark timing to advance with respect to a predetermined crankshaft position. Spark advance must be limited, however, so that the spark will not advance to such an extent that the engine will knock. A certain margin of safety must also be retained since the tendency of the engine to knock, upon advance of the spark, increases with age and wear on the engine; in other words, the knocking limit of the engine shifts downwardly with increasing use thereof.

Use of fuel of lower octane rating in gasoline-operated internal combustion engines additionally requires a certain margin of safety regarding knocking of the engine, so that the engine can operate even under unusual or difficult operating conditions without knocking. It is therefore necessary to provide a spark timing adjustment element, and particularly a spark advance system in which the spark advance is actually decreased if engine speed increases beyond certain critical limits.

Various arrangements have been proposed in order to decrease spark advance as the engine speed increases; they resulted, however, in complicated arrangements requiring a substantial number of additional parts and components.

It is an object of the present invention to povide an ignition distributor-breaker system in which spark advance is controlled by centrifugal weights, which is simple, reliable requires a minimum of components and yet is capable of decreasing the spark advance as engine speed increases.

Subject matter of the present invention: Briefly, a centrifugal timing element is provided which is formed as two link elements connected together by a spring-loaded knee joint. The knee joint has a stop. Below a certain critical speed, the spring loading connects the two link elements to operate as a single deflectable unit, with the stop of the two link elements engaged. When a certain critical speed is exceeded, however, the centrifugal force can overcome the spring force and cause the unity of the two link elements to deflect together to break, so that the link elements can rotate relative to each other about the knee joint, permitting rotation of one of the elements in a direction to cause spark retardation, whereas the other element can continue to deflect further under centrifugal force, counter the force of the spring which links the two link elements together. The timing cam itself is constantly biassed in the direction of spark retardation.

The system has the advantage that no substantial additional number of parts are needed in order to effectively cause retardation of the spark at high-speed operation with respect to its previous spark advance. It operates, generally on the concept that the centrifugal weight which engages the timing cam is merely separated into two link elements; the simplicity of the arrangement is striking.

The critical speed can be easily determined by adjustment of the spring bias force which retains the link elements of the centrifugal weight as one deflecting unit. This spring force should be so arranged that, during normal spark advance operation, the two link elements form an essentially stiff unit.

The deflection or breaking point of the knee joint is further determined by the position of the spring with respect to the link elements and the joint as such. If a pair of link elements are used, connected to a support plate, then the end positions of the connecting spring are so connected to the two link elements that they, upon engagement of the stop, form a stiff unit which can be broken by pivoting about a limit pin only when a predetermined speed is reached. The knee joint, in accordance with a preferred form of the invention, has a joint pin which is located to be slightly laterally of a straight line connection between the connecting points of the ends of the spring to the link elements, so that the spring must loop or bend over the pin by a slight amount. This contributes to keeping the link elements together as a stiff unit when below the critical speed, while permitting accurate setting of the critical speed.

The arrangement which merely subdivides the centrifugal weight or centrifugal element into two separate parts, connected by a knee joint, solves the problem of excessive spark advance at high speed and provides, effectively, for spark retardation with respect to its previous spark setting at the high speed. The exact critical speed, that is, the breaking of the stiff engagement of the elements about the knee joint, can readily be achieved by various components, such as limit stops, latch elements, springs, or the like.

Figure 2:
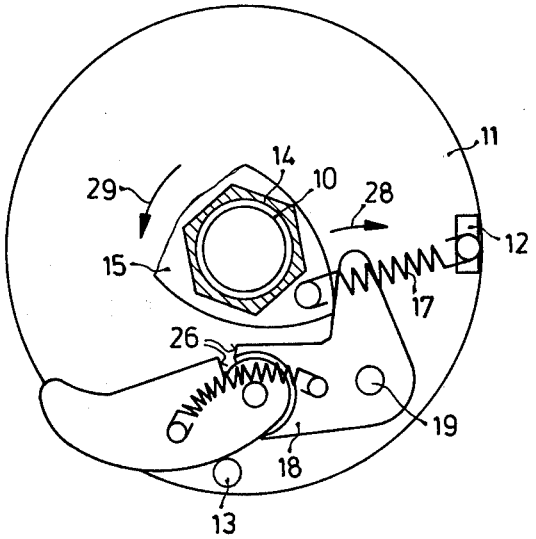

The invention will be described by way of example with reference to the accompanying drawings, wherein:

FIG. 1 is a schematic top view of the centrifugal spark timing control of a breaker assembly, in accordance with the present invention, and illustrating the position by the elements when the engine operates at an intermediate speed; and FIG. 2 is a view similar to FIG. 1, with the engine operating at high speed, the centrifugal element having pivoted at the knee joint.

The breaker timing arrangement of FIGS. 1 and 2 is illustrated in connection with a roll-off adjustment cam. Two pairs of centrifugal links are provided; only one of the pairs is illustrated in the drawings for simplicity, another pair of link elements similar to those shown being arranged at the upper and right-hand portion of the distributor (with reference to the drawings).

A shaft 10, driven by the internal combustion engine, has a carrier plate 11 secured thereto to rotate with the shaft. Carrier plate 11 is formed with an engaging hook 12 at the circumference and with a limit pin 13. Hook 12 and pin 13 extend approximately parallel to the shaft 10. Shaft 10 has a cam 14 located thereon, rotatable with respect to the shaft, but generally rotating with it. Cam 14 has a follower 15 secured to which a spring hook 16 is connected. A spring 17, hooked into hook 16 on the follower 15 on the one hand, and to the lug 12 on plate 11 on the other, has the tendency to pull the cam 14, by engagement with the follower 15, in counter-clockwise direction, that is, counter the direction of arrow 27.

Spark advance is effected by a centrifugal timing weight which, in accordance with the present invention, is formed as two link elements connected by a knee joint. The first link element 18 is pivoted on a pin 19 projecting from the carrier plate 11. It is formed with a projecting nose 20 engaging a roll-off surface formed on the follower 15, and held in engagement with the roll-off surface by the spring 17. The link element 18 carries a bolt 23 which engages in a matching opening in link element 21, forming thereby with the link element 21 a knee joint. The bolt 23 extends beyond the surface of the link element 21. A tension spring 24, for example in form of a spiral spring, as shown, is connected to the two link elements 18, 21 and positioned to fit around the pin 23, as clearly seen in FIGS. 1 and 2. Spring 24 is hooked into an engaging lug 25 formed on link element 21; a similar lug is formed on link element 18. The central axis of the pin 23 is offset laterally of a straight connecting line of the two lugs on the link elements 18, 21, so that the spring will deflect or slightly loop around the pin 23. The out-of-alignment distance of the pin 23 is small with respect to the length of the spring. The slight lateral offset of the pin 23 with respect to a straight line connecting the two lugs 25, with the direction of offset being away from the limit stop 13, causes the spring 24 to press the two link elements 18, 21 in a position in which their stop surfaces 26 will be in engagement to form, effectively, a single centrifugally deflectable unit, as seen in FIG. 1.

Operation: FIG. 1 illustrates the link elements in a position when the engine is operating at a medium speed. The link elements 18, 21 form a complete relatively stiff unit which has already rotated under influence of centrifugal force about pin 19 in counter-clockwise direction, that is, in direction of arrow 27 to press the follower 15 in counter-clockwise direction. Rotation of link unit 18-21 has been limited by the stop limit 13. The outwardly directed swinging movement of the element 18 presses the projecting nose 20 counter the force of the biassing spring 17 on follower 15, so that follower 15 deflects in the direction of arrow 27 to advance the spark timing. The cam 14 will rotate relatively to shaft 10.

As engine speed increases and reaches a critical speed, the centrifugal force will overcome the restraining force of the spiral spring 24 acting between the link elements 18 and 21. The previously fixed, relatively stiff centrifugal weight formed of link elements 18 and 21 is then broken, so that the elements 18, 21 will pivot with a knee joint action with respect to each other about the pivot point 22, formed by pin 23. This causes element 21 to move element 18 in the direction of arrow 28, that is in clockwise direction, inwardly, so that the cam 14 can be rotated relative to its previous position under force of the bias spring 17 in a direction tending to retard the spark with respect to the position shown in FIG. 2. The follower 15 will thus deflect in direction of the arrow 29.

Upon decrease in rotary speed of the engine, and thus decrease of the centrifugal force acting on the link element 21, the force of spring 24 will tend to retract the link element 21. When the restoring force of spring 24 is greater than the centrifugal force acting on link element 21, link element 21 will snap backwardly and ignition timing will again advance, the two link elements 18, 21 again forming one complete unit, as shown in FIG. 1. Upon further decrease in rotary speed of the engine, the two link elements 21, 18 wll rotate as a unit in the direction of arrow 28, causing further retardation of the spark.

Various changes and modifications may be made within the scope of the inventive concept.

We claim:

1. Ignition distributor-breaker system for the timing of an ignition event in internal combustion engines, with centrifugal timing adjustment having a shaft (10) driven by the crankshaft of the engine; a support plate (11) driven by the shaft;

a timing cam (14) concentric with the shaft and rotatable with the plate (11) and hence with the shaft while being additionally rotatable with respect to the plate (11) and hence the shaft (10);

bias means (17) resiliently biassing the timing cam to rotate in a direction tending to retard the spark;

centrifugal timing means (18, 21) secured to the plate (11) and engaging the timing cam (14) to adjust its relative rotary position with respect to the plate (11) to effect spark advance or retard upon relative change of rotary position of the cam with respect to the shaft when the cam is engaged by ignition breaker contacts;

and limit means (13) limiting excursion of the timing means (18, 21) under influence of centrifugal force characterized in that the centrifugal timing means comprises two link elements (18, 21), one (18) of which engages the timing cam (14);

and a knee joint (22, 26) and spring means (24) connecting said link elements (18, 21), said link elements forming a single centrifugally deflectable unit below a critical speed, the centrifugal force above said critical speed overcoming the connecting force of said spring means and permitting the other (21) of said link elements to deflect about the limit means (13) and thus break the deflecting unity of the link elements (18, 21) and permit rotation of the said one link element (18) with respect to the other (21) and consequently rotation of the timing cam (14) in the direction of spark retardation under the influence of the bias means (17).

2. System according to claim 1, wherein the spring means comprises a tension spring (24) connected respectively to the link elements (18, 21) and spanning the knee joint (22, 26), said knee joint having a stop (26) to prevent rotation of the link elements (18, 21) with respect to each other in a direction beyond a predetermined relative alignment.

3. System according to claim 1, wherein the link elements (18, 21) are formed with cooperating stop means (26) limiting relative rotation beyond a predetermined relative alignment, and the spring means (24) connecting the link elements are positioned with respect to the knee joint (22, 26) to form a resiliently connected centrifugally deflectable unit, the spring means holding the elements in position with the stop means (26) thereon engaged when the elements form the single deflectable unit, below the critical speed, the centrifugal force overcoming the spring force holding the elements engaged at the stop means (26) when the critical speed is exceeded and permitting relative rotation of the elements by bending said knee joint away from the stop means.

4. System according to claim 3, wherein the knee joint comprises a knee pin (23) and the spring means comprises a tension spring (26) connected to the link elements (18, 21), the relative positions of the knee pin, the spring means, and the connection points of the spring means to the link elements being out of straight-line alignment to cause the spring means (24) to flex around said knee pin (23).

5. System according to claim 4, wherein the out-of-alignment position of the knee pin (23) is small with respect to the length of the spring means (24).

6. System according to claim 4, wherein the limit means (13) comprises a stop positioned for engagement by the other (21) of said link elements, located intermediate said knee pin (23) and the end of said link element having the greatest distance from the center of the shaft (10).

* * * * *